US005470371A

United States Patent [19]

Darolia

[11] Patent Number: 5,470,371

[45] Date of Patent: Nov. 28, 1995

[54] DISPERSION STRENGTHENED ALLOY CONTAINING IN-SITU-FORMED DISPERSOIDS AND ARTICLES AND METHODS OF MANUFACTURE

[75] Inventor: Ramgopal Darolia, West Chester, Ohio

[73] Assignee: General Electric Company, Cincinnati, Ohio

[21] Appl. No.: 850,363

[22] Filed: Mar. 12, 1992

[51] Int. Cl.[6] ..... B22F 3/15; C22C 19/05

[52] U.S. Cl. ..... 75/229; 75/236; 75/243; 75/246; 75/343; 419/11; 419/29; 419/49; 419/53; 148/514; 148/410

[58] Field of Search ..... 75/238, 241, 243, 75/246, 343, 229, 232, 236; 419/11, 29, 49, 53; 148/514, 410

[56] References Cited

U.S. PATENT DOCUMENTS

| | | | |
|---|---|---|---|
| 3,642,543 | 2/1972 | Owczarski et al. | 148/12.7 |
| 3,677,331 | 7/1972 | Lund et al. | 164/122 |
| 3,785,876 | 1/1974 | Bailey | 148/2 |
| 3,793,012 | 2/1974 | Walter et al. | 75/171 |
| 3,915,761 | 10/1975 | Tschinkel et al. | 148/32 |
| 4,116,723 | 9/1978 | Gell et al. | 148/3 |
| 4,209,348 | 6/1980 | Duhl et al. | 148/3 |
| 4,283,234 | 8/1981 | Fukui et al. | 148/32.5 |
| 4,284,430 | 8/1981 | Henry | 75/170 |
| 4,288,259 | 9/1981 | Pearson et al. | 148/32 |
| 4,292,076 | 9/1981 | Gigliotti et al. | 75/170 |
| 4,305,761 | 12/1981 | Bruch et al. | 148/3 |
| 4,359,352 | 11/1982 | Ray et al. | 148/31 |
| 4,418,124 | 11/1983 | Jackson et al. | 428/548 |
| 4,459,160 | 7/1984 | Moetham et al. | 148/3 |
| 4,668,312 | 5/1987 | Benn et al. | 148/410 |
| 4,849,030 | 7/1989 | Darolia et al. | 148/3 |
| 5,087,301 | 2/1992 | Angers et al. | 148/12.7 |
| 5,122,206 | 6/1992 | Wakita et al. | 148/404 |

*Primary Examiner*—Ngoclan Mai

*Attorney, Agent, or Firm*—Andrew C. Hess; David L. Narciso

[57] ABSTRACT

Articles having improved strength at high temperature are made from near-eutectic nickel-base superalloys. In such alloys, the improved properties are achieved by preventing the formation of a dispersed second phase during the production of alloy powder. After the powder is consolidated, a dispersion of the second phase is developed through thermal treatment. Consolidation may be achieved by direct application of pressure, or by incremental solidification processes. Some of these alloys are formulated to achieve additional strengthening by precipitation hardening.

26 Claims, 8 Drawing Sheets

100X

100X

200X

100X

100X

DISPERSION STRENGTHENED ALLOY CONTAINING IN-SITU-FORMED DISPERSOIDS AND ARTICLES AND METHODS OF MANUFACTURE

This invention is related to U.S. Pat. No. 4,849,030—Darolia et al., which is assigned to the assignee of the present invention, and is incorporated herein by reference.

BACKGROUND OF THE INVENTION

This invention pertains to a method for manufacturing materials suitable for use at high temperatures, particularly at temperatures and under conditions encountered in gas turbine engines, and to articles made from such materials.

The efficiency of gas turbine engines depends significantly on the operating temperature in the various sections of the engine, with increased operating temperatures resulting in increased efficiencies. The search for increased efficiencies has led to and continues to result in the development of materials which can withstand increasingly high temperatures while retaining their basic material properties, and novel manufacturing processes which permit exploitation of the capabilities of these materials. Limitations and capabilities of such alloys are generally traceable to their metallurgical structures and manufacturing processes employed in producing them.

One important aspect of metallurgical structure is active strengthening mechanisms; in nickel-base alloys, those may include solid solution strengthening, precipitation hardening and dispersion strengthening. There are commercially available alloys which exploit each of these strengthening mechanisms. Nichrome and Hastelloy X rely on solid solution strengthening. Rene'95 and IN-100 are examples of alloys which are strengthened primarily by a precipitate of the gamma-prime phase. TD Nickel is a dispersion strengthened alloy, in which thoria particles are formed by the in-situ oxidation of metallic thorium. MA 754 is a dispersion strengthened alloy which is comprised of a dispersion of yttria particles in a matrix similar to Nichrome, produced by a mechanical alloying process. There are significant limitations associated with each type of strengthening mechanism, including the extent to which strengthening can be achieved, the temperatures over which strengthening is effective and limitations in processing inherent in the alloy.

One approach to improving the capabilities of nickel-base superalloys has been reinforcing the alloys with fibers which are strong and stable at elevated temperatures. Such materials are termed metal matrix composites (MMC). In these materials, a metal matrix is reinforced with fibers of a high strength metal or nonmetallic material such as an oxide or carbide. MMC technology not only capitalizes on the high strength and stiffness of these materials, but provides the additional capability of orienting the reinforcing fibers in such patterns as may be most appropriate to carrying the loads imposed on the article in service. One of the limitations to using MMC materials is that the maximum operating temperatures are generally determined by the capabilities of the matrix material.

A special class of MMC superalloys is the directionally solidified eutectic alloys, in which reinforcing fibers, grown during directional solidification of a eutectic alloy, are embedded in a matrix comprised of a base material, such as nickel, and various alloying elements. As described in U.S. Pat. No. 4,305,761—Bruch et al., aligned metallic carbide reinforcing fibers are embedded in a nickel-base gamma/gamma-prime matrix in which the gamma-prime strengthening phase is dispersed in the gamma phase. The carbide reinforcing fibers, of the MC or monocarbide type, are those of which the metal preferably is principally Ta, but can include, in addition, such metals as Mo, W, Re and Nb. A significant limitation to the use of such materials is that the reinforcing fibers must be grown from the liquid by eutectic reaction, by directional solidification at very slow rates, typically on the order of 0.25 inch per hour, which further implies that the size of any part made by this process must be relatively small and of such configuration that the substantially parallel alignment of the fibers is appropriate.

The capabilities of superalloy articles are significantly affected by the processes employed in their manufacture. For examples, superalloys made as forgings or wrought mill products must be soft and ductile enough that they can be deformed without breaking. As a result there is a practical limitation to the strength levels usable in such materials. On the other hand, cast superalloys can be formulated to have greater strength at higher temperatures, but they are vulnerable to inhomogeneous distribution of alloying elements, shrinkage and other casting defects and, frequently, low ductility.

Novel manufacturing processes including powder metallurgy and incremental solidification processes such as rapidly solidified plasma deposition (RSPD) have been developed to circumvent some of the limitations associated with the more traditional processes. As applied to superalloys, powder metallurgy technology includes solidification of individual powder particles from droplets of liquid metal, followed by powder conditioning, hot consolidation, and sometimes forging. Powder metallurgy processing can yield materials having greater homogeneity than castings and higher strengthener content than conventionally processed wrought materials. This technique is widely used in the aircraft gas turbine engine industry for producing articles from alloys that are extremely difficult to process by other methods.

The RSPD process is one of several processes included within the term incremental solidification, in which droplets of liquid metal are brought into contact with a solid substrate maintained at a temperature low enough to cause the droplets to freeze. The droplets, typically flattened by coming in contact with the substrate, adhere to the substrate and freeze very rapidly, thereby depositing droplet material on the substrate, generally under nonequilibrium conditions. Where the substrate and the droplets have substantially the same composition, the net effect is to gradually build up a solid article of that composition. Where the substrate and the droplets have significantly different compositions, there will typically be a distinct boundary between the substrate and the deposited material; however, once a complete layer of droplet material has been made, subsequent deposition thereof proceeds in the same fashion as where the substrate and droplets are of the same composition. This sequence is particularly useful for manufacturing an article of the droplet material, where the configuration of the article is derived from that of the forming mandrel on which the droplet material is deposited. It is also useful for making an ingot from the droplet material. Each of these variations is within the scope of the term incremental solidification.

In RSPD processing, powder particles are fed into a plasma flame, where they are melted to form droplets of liquid. The plasma flame directs the stream of droplets against a substrate, where the droplets adhere and solidify. The production of superalloy articles by RSPD is described in U.S. Pat. No. 4,418,124—Jackson et al., and the prior art referenced therein; said patent is incorporated herein by reference. Another incremental solidification process is often called spray forming. The principle of spray forming differs from RSPD processing only to the extent that droplets of liquid are formed directly from the melt, rather than by remelting powder particles. Thus the difference in properties of an article made by RSPD and one made by spray forming may be negligible.

Within the context of the present invention a distinction is made between an equilibrium structure, which is reasonably stable at intended operating conditions, such as those encountered in a gas turbine engine, but which can be achieved through commercially practical heat treatment operations, and a nonequilibrium structure, which can be achieved only through special precautions to avoid what would otherwise be considered an equilibrium structure, such as, for example, a metastable structure obtained by quenching from a high temperature. A distinction is also made between a dispersoid, which is an essentially insoluble atomic, molecular or intermetallic species distributed essentially uniformly throughout a metallic matrix in the form of very small particles, and a precipitate, which is an atomic, molecular or intermetallic species distributed essentially uniformly throughout a metallic matrix in the form of very small particles, but which can be readily dissolved and reprecipitated by thermal treatment. Once a dispersoid has been developed, whether by in-situ oxidation, mechanical alloying or by the methods of the present invention, it can be altered only slightly by any solid state thermal treatment. The term dispersion is used to describe the distribution of dispersoid particles in the material.

The present invention provides several combinations of alloy composition and manufacturing method which yield materials having greater strength at higher temperature than materials heretofore employed. The present invention utilizes less conventional manufacturing processes to achieve metallurgical structures and resulting materials properties not achievable through conventional processing. Such less conventional manufacturing processes exploit the principle of first preventing the formation of, then subsequently inducing the growth of, one or more discrete phases which strengthen superalloys. Alloys of the present invention have been formulated to provide a material having good resistance to oxidation in a high velocity stream of hot air, and to raise the temperature at which superalloy and MMC articles can be used.

SUMMARY OF THE INVENTION

In accordance with the present invention, it has been found that articles having improved strength at high temperature can be achieved in near-eutectic nickel-base superalloys through several novel methods of manufacture. Specifically, it has been found that in some near-eutectic nickel-base alloys it is possible to prevent the formation of a dispersed second phase during the production of powder, and subsequently develop a dispersion of the second phase through thermal treatment. The powder can be consolidated by any convenient method, including, but not limited to, sintering, hot isostatic pressing (sometimes called HIP'ing), rolling, or extrusion. In addition, it has been found that ingots and other solid articles of such superalloys can be made by incremental solidification processes. Furthermore, it has been found that such superalloys are useful as matrix materials for metal matrix composite articles. In the superalloys described herein, it is possible to achieve strengthening through three different complementary mechanisms, solid solution strengthening, dispersion hardening and precipitation hardening. In these alloys, the latter two strengthening mechanisms may be manipulated separately by thermal treatment, to achieve various combinations of structure and mechanical properties.

DETAILED DESCRIPTION OF THE INVENTION

This invention relates to superalloys of near-eutectic composition solidified under conditions which prevent the growth of at least one discrete phase. To prevent such growth during solidification, alloy compositions are selected which are preferably eutectic or hypo-eutectic, but generally not hyper-eutectic, and the rate of solidification must be sufficiently rapid to prevent formation of at least one discrete phase. The resulting metastable solid solution is subsequently thermally treated at a combination of temperature and time sufficient to develop a dispersion of that phase in the matrix. Once such dispersions are formed, they are thenceforward substantially insoluble in the matrix.

Figure 1:
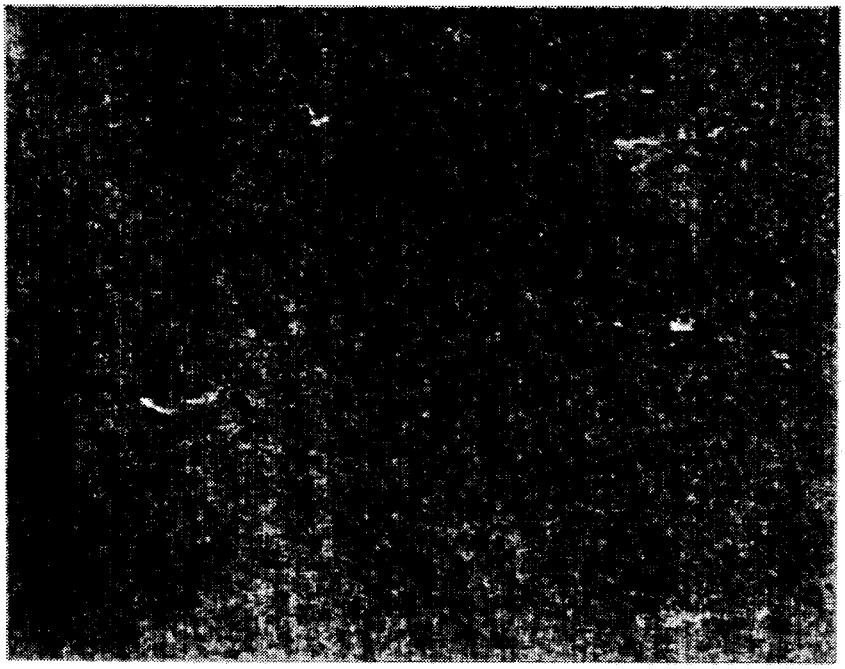
FIG. 1 is an optical photomicrograph of an RSPD deposit, in the as-deposited condition (prior to thermal treatment). Magnification is 100×.

As described in U.S. Pat. No. 4,849,030—Darolia et al., it was found that the growth of discrete MC particles could be prevented during the solidification of a single crystal article, which is solidified at rates of about 4 to 20 inches per hour. In this invention, the superalloy of near-eutectic composition may be produced as small particles, such as powder made by atomization, or any other convenient process. In conventional powder making processes, the rate of solidification is many times faster than that employed in producing single crystal articles, and thus the growth of at least one discrete phase is readily prevented. Also, formation of such discrete phases is readily prevented during incremental solidification, as shown in FIG. 1. It has been found that articles made in accordance with the present invention are typically polycrystalline. It has also been found that the range of compositions in which the growth of discrete phases can be prevented in polycrystalline materials such as formed from powder is slightly different from the range of compositions of the single grain article in which the growth of discrete phases can be prevented. The difference is attributable in part by the need to prevent formation of the discrete phases during the relatively slower solidification process in single grain or single crystal articles.

Figure 2:
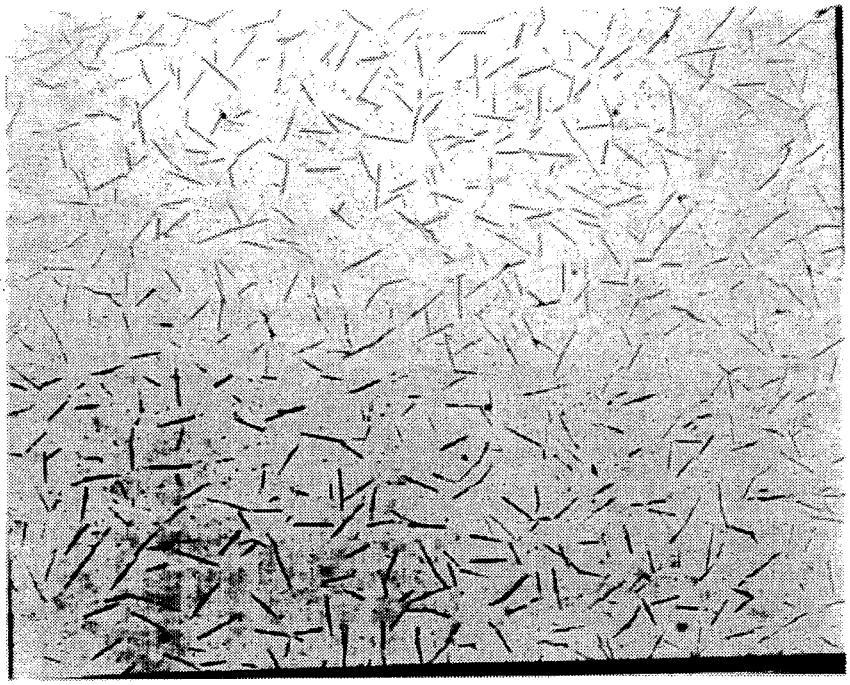
FIG. 2 is an optical photomicrograph of an RSPD deposit, after thermal treatment. Magnification is 100×.
Figure 3:
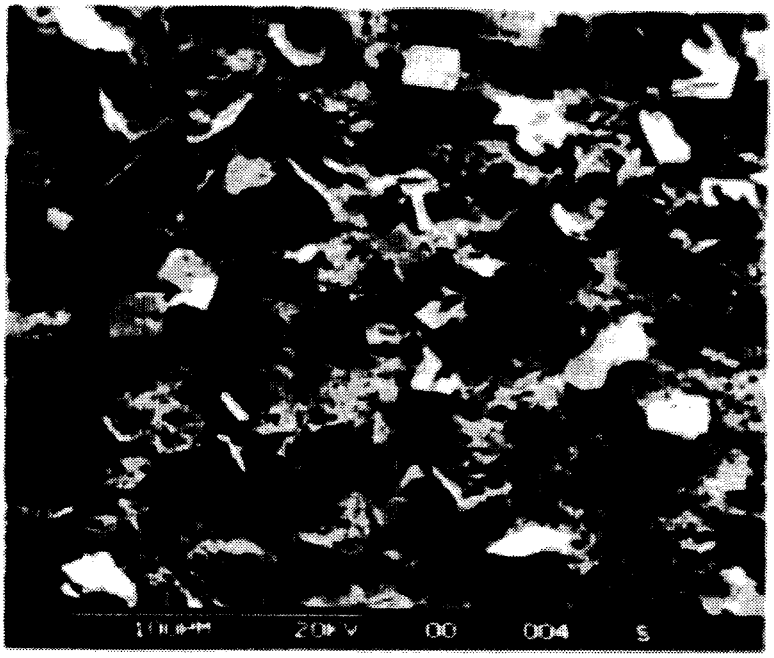
FIG. 3 is a scanning electron micrograph of an RSPD deposit, after thermal treatment. Surface was electrolytically etched; thus the carbide particles stand out in relief. Magnification is 200×.
Figure 4:
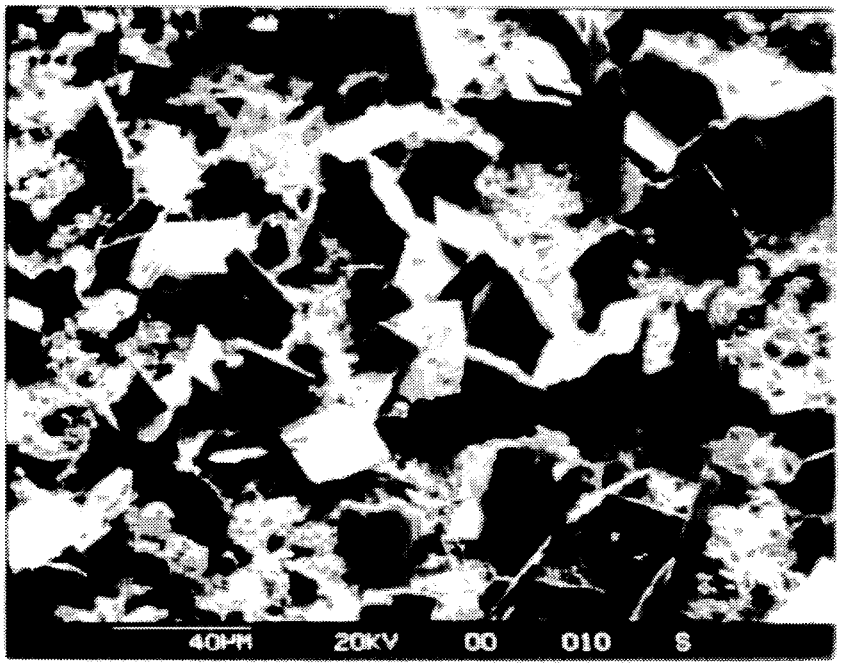
FIG. 4 is a higher magnification scanning electron micrograph of the same RSPD deposit shown in FIG. 3, after thermal treatment. Surface was electrolytically etched; thus the carbide particles stand out in relief. Magnification is 500×.

The dispersoids which are precipitated into the matrix alloy according to this invention are generally in the form of discrete platelets, rather than aligned fibers, as described by Bruch et al. The shape and growth morphology of the platelets are illustrated in FIGS. 2 through 4, which are photomicrographs of a thermally treated RSPD deposit. Such dispersoids contribute significantly to the strength of these alloys, particularly under conditions where creep and stress rupture represent significant design considerations. The improvement in creep and stress rupture behavior is attributed to inhibition of grain boundary sliding, because of the carbide platelets in the grain boundary region. Thus, the existence of the dispersoids effectively increases the maximum use temperature of superalloys.

Typical nickel-base superalloy compositions (in weight percent) which are appropriate to the invention are listed in Table 1, below.

TABLE 1

COMPOSITIONS OF NICKEL BASE ALLOYS

| | Preferred | More Preferred | Especially Preferred |
|---|---|---|---|
| Aluminum (Al) | 4.0–7.0 | 5.0–6.5 | 5.3–5.7 |
| Chromium (Cr) | 3.0–10.0 | 4.0–7.5 | 4.0–4.4 |
| Tungsten (W) | 2.0–8.0 | 3.0–6.0 | 4.3–4.7 |
| Rhenium (Re) | 0–9.0 | 3.0–7.5 | 6.6–7.1 |
| Tantalum (Ta) | 4.0–14.0 | 5.0–12.0 | 8.2–8.6 |
| Cobalt (Co) | 0–14.0 | 3.0–14.0 | 3.8–4.2 |
| Niobium (Nb) | 0–2.0 | 0–2.0 | 0–0.2 |
| Molybdenum (Mo) | 0–6.0 | 0–4.0 | 3.0–3.4 |
| Carbon (C) | 0.1–0.5 | 0.15–0.35 | 0.21–0.25 |
| Boron (B) | 0–0.04 | 0–0.04 | 0.025–0.035 |
| Zirconium (Zr) | 0–0.2 | 0–0.2 | 0–0.1 |
| Hafnium (Hf) | 0–1.0 | 0–0.5 | 0.08–0.12 |
| Titanium (Ti) | 0–4.0 | 0–2.0 | 0–0.2 |
| Yttrium (Y) | 0–0.1 | 0.02–0.1 | 0.045–0.055 |
| Vanadium (V) | 0–3.0 | 0–3.0 | 0–0.2 |
| Oxygen (O) | <1000 ppm | <300 ppm | <300 ppm |

The balance being nickel and incidental impurities.

While the invention is described as a nickel-base near-eutectic alloy in which the dispersoid is a monocarbide, specifically TaC, and the precipitate is the gamma-prime phase, the invention contemplates a much larger class of materials. In addition to the TaC dispersoid used in the alloys described above, it will be recognized that other carbides such as $Ta_6C$, NbC, TiC, $Cr_2C_3$, $Cr_3C_7$, ZrC, HfC, WC, $W_6C$, ReC, $Mo_6C$ and MoC, or mixtures or alloys thereof, and other dispersoids such as molybdenum and $Ni_3Nb$ could be used in these near-eutectic nickel-base superalloys. The invention also contemplates near-eutectic cobalt-base and iron-base superalloys, and iron-nickel-base superalloys.

Some superalloys exhibit a precipitation reaction which strengthens the matrix. This reaction and its product are to be distinguished from a dispersoid precipitation reaction whose product is a dispersion of particles of one or more phases of the eutectic. The dispersoid reaction may be allowed to occur concurrently with the matrix strengthening precipitation reaction or, preferably, the reactions may be caused to occur separately. To illustrate, a gamma-prime hardened nickel-base eutectic superalloy having gamma and particulate TaC as the continuous (matrix) and discrete equilibrium phases, respectively, of the eutectic, and which also exhibits a gamma-prime reaction, is selected. Gamma-prime will dissolve in the gamma matrix when the temperature is raised above the gamma-prime solvus temperature, and reprecipitate when the temperature drops below the gamma-prime solvus. This may occur during any portion of the manufacturing sequence by which an article is made of this material, including cooling that immediately follows solidification. In the generalized processing sequence, the article is heated to a temperature (gamma-prime solvus) sufficient to take the precipitated gamma-prime into solution, at which temperature the dispersoid reaction may also occur. Thereafter, the supersaturated (with respect to gamma-prime) matrix with the dispersoid is brought to the appropriate aging temperature and the gamma-prime is precipitated into the gamma matrix. Hardening by forming a gamma-double-prime precipitate is also contemplated in the present invention.

In the preferred embodiment of the invention, the dispersoid reaction is conducted first. Thereafter, the article is heated to a different temperature to solution the gamma-prime phase, then cooled and subsequently aged at a lower temperature than the dispersoid reaction temperature. In some alloys, a second aging treatment is advantageously employed, at a lower temperature than the first, to precipitate additional amounts of gamma-prime and to otherwise improve the properties of the matrix. Since the time required to solution the gamma-prime is relatively short, the more stable dispersoids will be only slightly affected. An advantage to this multi-step sequence is that the dispersoids are precipitated at the lowest temperature and, therefore, are finer than if precipitated at the higher gamma-prime solutioning temperature, and more effective in strengthening the article.

The improvement in strength at high temperatures which characterizes the articles of this invention can be effectively utilized by using these materials as matrices for MMC materials. Inasmuch as the temperature capability of the matrix frequently controls the temperature capability of the composite, a significant improvement is achieved. Since the improvement is related to the matrix alloy, any convenient type of reinforcing fiber, such as carbide, oxide, nitride, carbonitride or oxynitride, may be employed, provided that the fibers are compatible with the matrix alloy. Fibers may be coated to enhance compatibility. Also, since the articles of this invention can be produced by many of the methods commonly used to fabricate MMC articles, such as HIP'ing, rolling, extrusion, RSPD, etc., it is apparent that these alloys are amenable to use as matrix materials in MMC articles.

There are many variations in the methods and materials disclosed and claimed herein that would have no consequential effect on the effectiveness of the present invention. For example, in many metallurgical processes it is possible to raise temperature and reduce the process time, and conversely, without substantively changing the result of the process. Further, it is difficult to control furnace temperatures such as those recited herein more closely than about 25° F. above or below the recited temperature. Thus, the recitation of a single temperature herein should be construed as including a range of at least 25° F. above and below that temperature. Similarly, other such variations should be regarded as within the intended scope of the present invention.

In order that those skilled in the art will be better able to practice the invention, the following examples are given, by way of illustration, and not by way of limitation.

EXAMPLE 1

In one experiment, powder having a nominal composition, in weight percent, of 5.53% Al, 4.2% Cr, 4.5% W, 6.85% Re, 8.42% Ta, 3.95% Co, 3.18% Mo, 0.23% C, 0.03% B, 0.1% Hf, 0.05% Y, Remainder Ni was deposited by RSPD processing on the surface of cylindrical steel forming mandrel. The approximate dimensions of the mandrel were about 1.5 inches diameter by about 4.5 inches long; the nominal thickness of the deposit was about 0.6 inch. The values of the major process parameters employed in RSPD processing were: gun power—about 50 kW; mandrel pre-heat temperature—1800°–1900° F.; chamber pressure—30–60 torr; powder feed rate—about 10 lbs/hr; gun-to-workpiece distance—10–12 inches. It was found that there is considerable latitude in the ranges of RSPD processing parameters that produce acceptable RSPD deposits. The resulting microstructure, shown in FIG. 1, indicates that no carbide particles were formed during RSPD processing. The mandrel was leached away from the tube in nitric acid. A similar tube having a wall thickness of approximately 0.3 inch was also made. The two tubes were thermally treated about 6 hours at 2100° F.; followed by further thermal treatment of about 4 hours at 2400° F., cooling at approximately 100° F./minute to 1975° F., where they were held for about 16 hours; they were then cooled to 1650° F., and aged at that temperature for 16 hours. The microstructures resulting from such thermal processing are shown in FIGS. 2 through 4. Note the platelet-type TaC dispersoids which were developed during the thermal treatment cycle. The shape and distribution of such dispersoids are characteristic of this invention.

EXAMPLE 2

Figure 5:
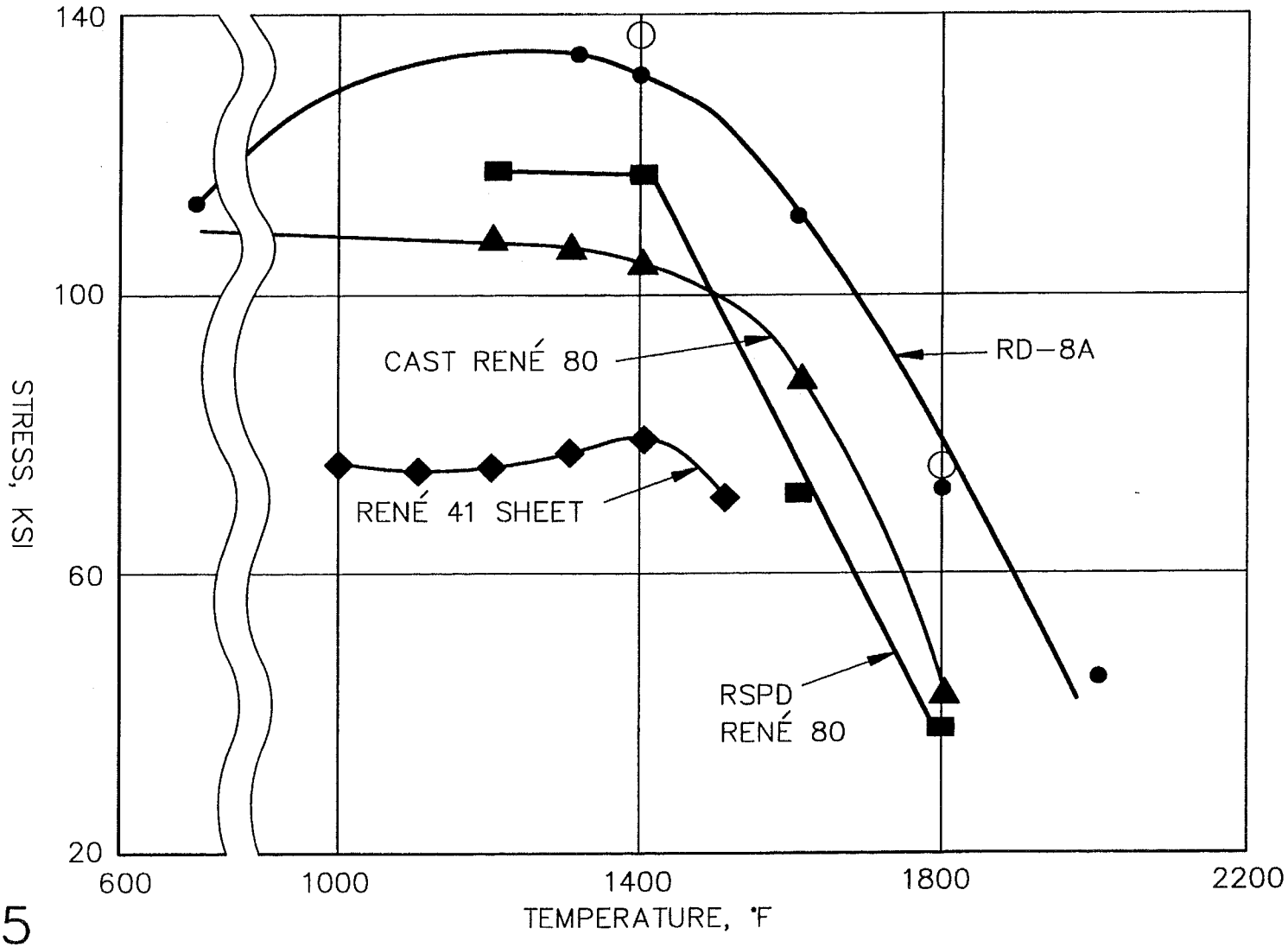
FIG. 5 is a graph showing the yield strength of the alloy of especially preferred composition of this invention, RD-8A, in comparison with yield strengths of other nickel-base superalloys.
Figure 6:
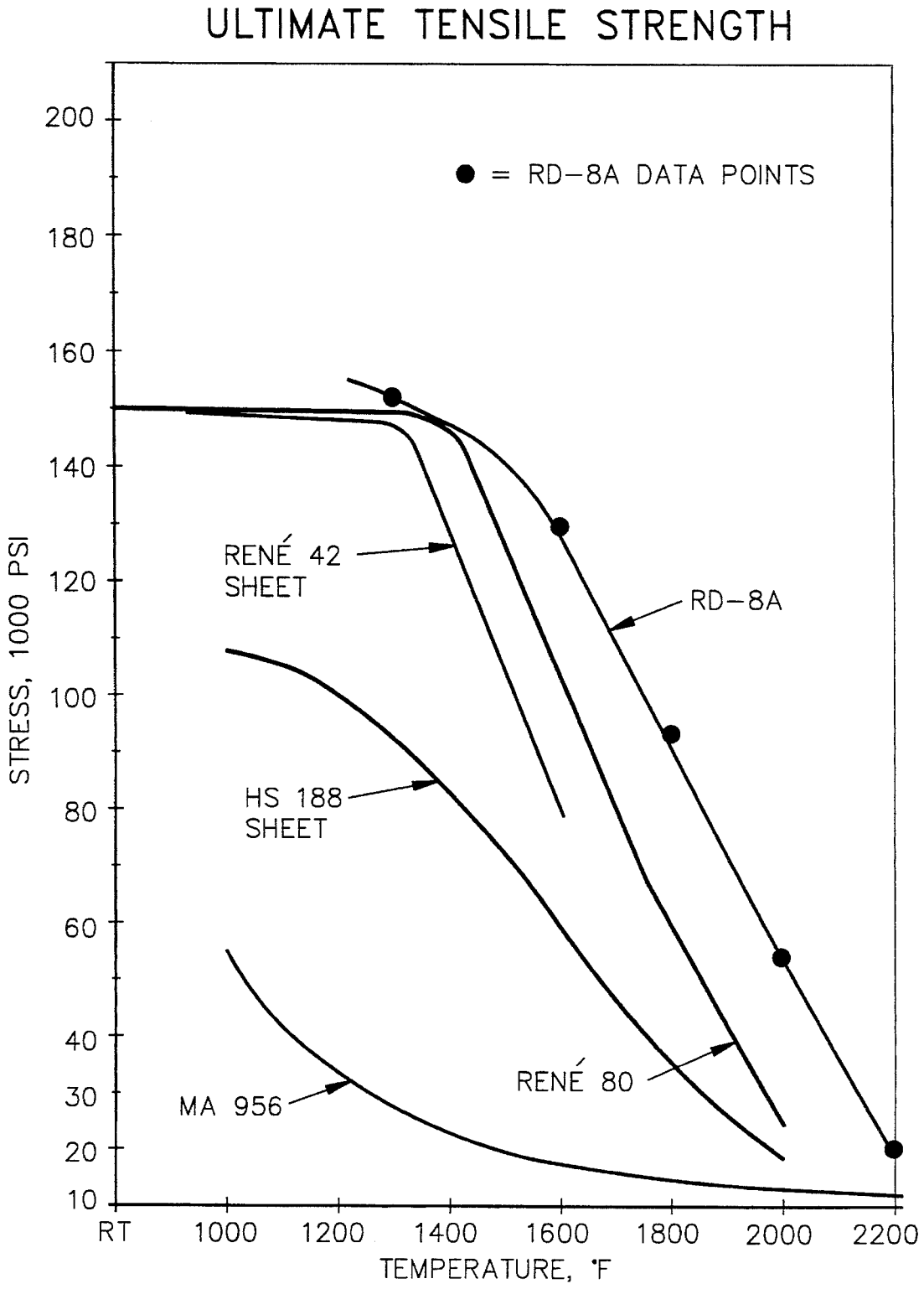
FIG. 6 is a graph showing the ultimate tensile strength of the alloy of especially preferred composition of this invention, RD-8A, in comparison with ultimate tensile strengths of other nickel-base superalloys.

Test coupons for tensile testing were cut from tubes produced in Example 1. Results of these tests, and results of other similar tests, are shown in FIGS. 5 and 6. These Figures also show the tensile properties for coarse grain cast Rene'80, a representative turbine blade alloy, and rolled Rene'41 sheet, a representative wrought material. It can be seen that the tensile and yield strengths of the material of this invention in the 1400° to 2000° F. range, which is an important range in gas turbine engine operation, are far superior to the two reference materials.

EXAMPLE 3

Figure 7:
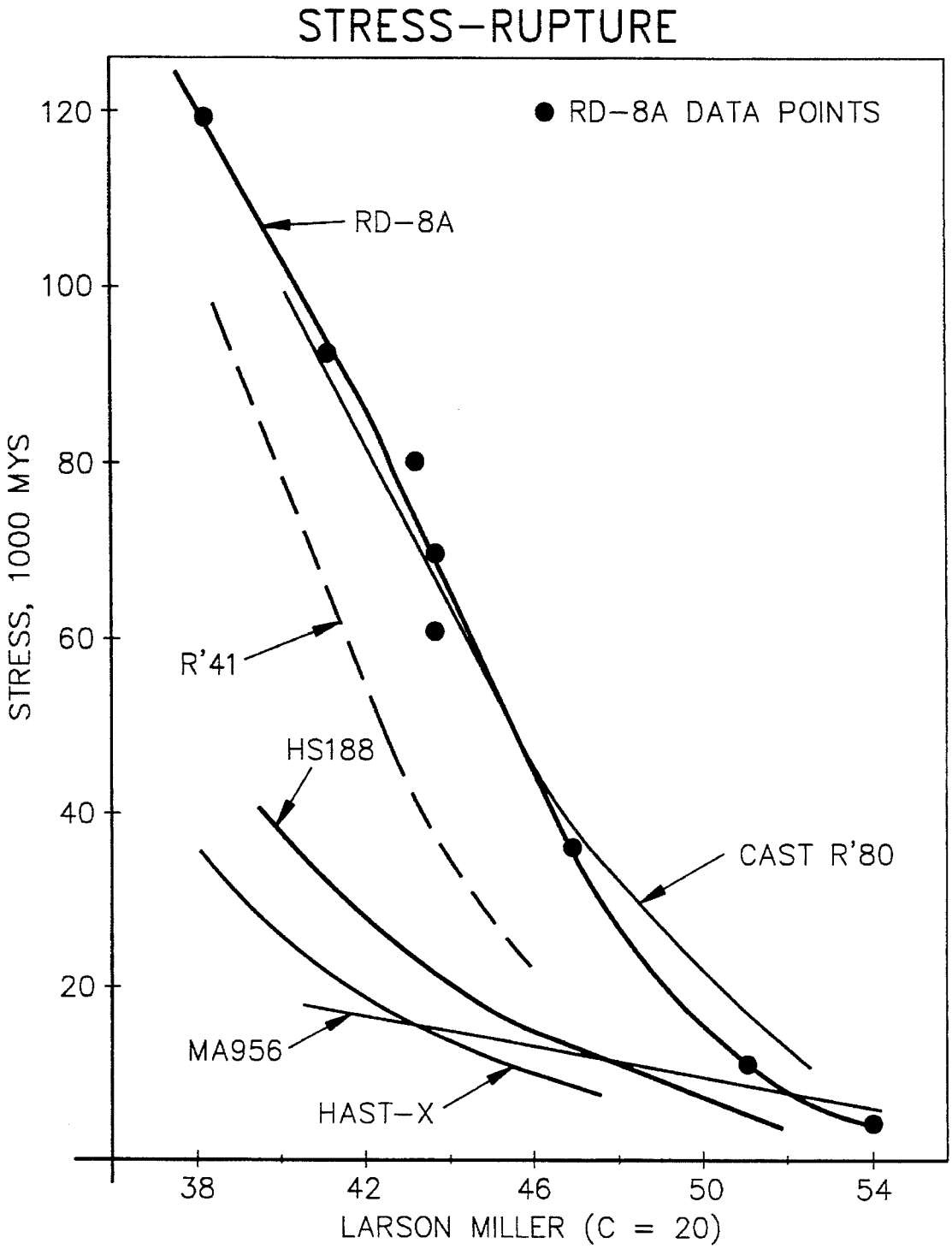
FIG. 7 is a graph showing the stress rupture behavior of the alloy of especially preferred composition of this invention, RD-8A, in comparison with the stress rupture behavior of other nickel-base superalloys. The graph is presented in Larson-Miller format, in which the stress is plotted against the Larson-Miller parameter, which combines the effects of temperature and rupture life.

A second set of test coupons was cut from the tubes produced in Example 1 for stress rupture testing. The results, presented in FIG. 7, show that the alloy of this invention has rupture strength approximately equivalent to coarse-grain cast Rene'80, and far superior to wrought Rene'41.

EXAMPLE 4

A third set of test coupons was cut from the tubes produced in Example 1 for low-cycle fatigue testing. The data are presented in Table 2, below. The tests were conducted at 1800° F., strain range of 0.4%, a ratio of alternating to mean stress of about 1, and a frequency of 0.33 Hz.

TABLE 2

LOW-CYCLE FATIGUE OF NICKEL-BASE ALLOYS

| Alloy | Cycles to failure |
|---|---|
| Cast Rene'80 | 3,200 |
| Wrought Hastelloy X | 5,500 |
| Alloy of Example 1 | 18,500 |

EXAMPLE 5

Figure 8A:
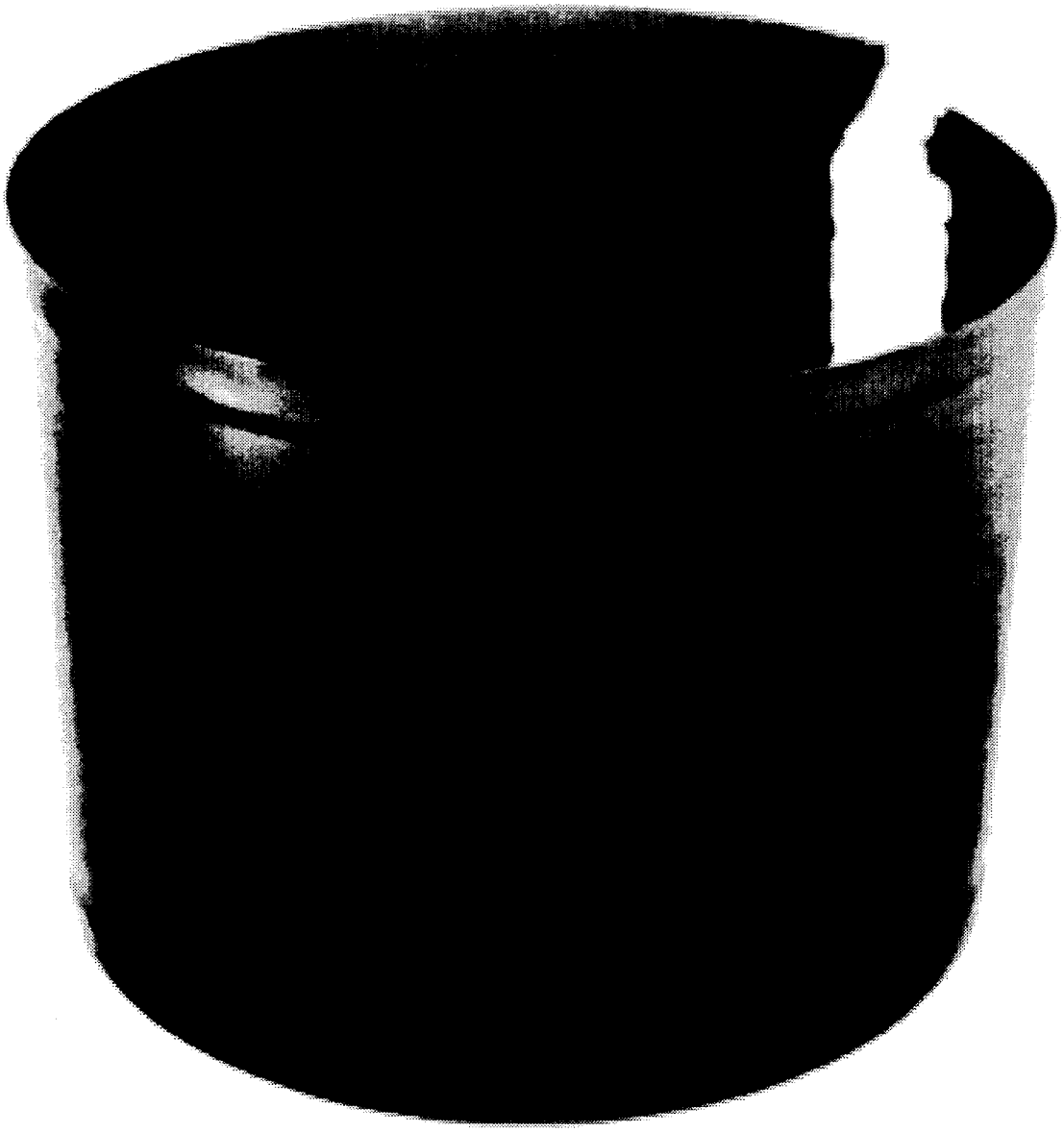
FIG. 8 is a photograph of a thin wall tube made by RSPD processing, after (a) slitting and (b) thermal treatment.
Figure 8B:
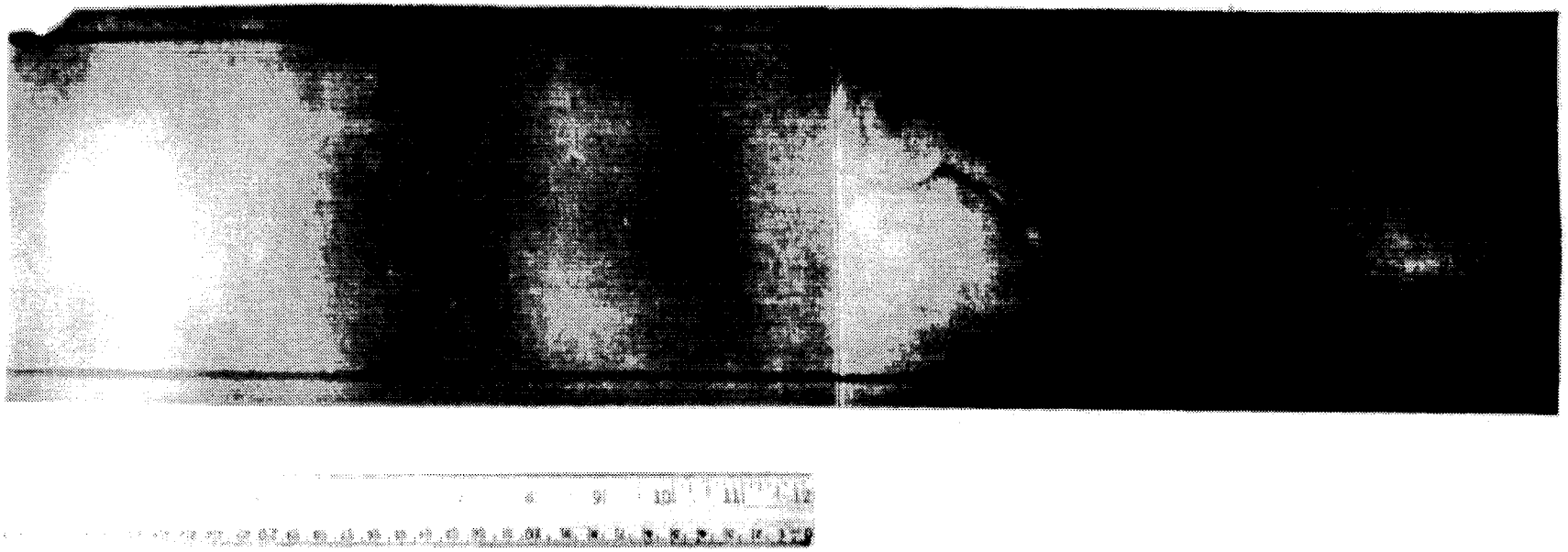

In other tests, thin-wall tubes were made by depositing the same alloy by RSPD onto larger mandrels. In one test, the approximate dimensions of the mandrel were 7.5 inches diameter by 6 inches long; the nominal thickness of the deposit was 0.02 inch. Values of the major process parameters employed in RSPD processing were those of Example 1. The deposited material was removed from the mandrel by leaching away the mandrel in nitric acid. The tube was then slit and thermally treated for about 6 hours at 2100° F.; during the first 15 minutes of this process, the deposit flattened into a sheet, under its own weight. A photograph of such a tube is shown in FIG. 8. It was concluded that the deposit could be readily formed early in the thermal treatment, but that formation of dispersoid, which required a longer thermal treatment, strengthened the material to resist further deformation. This is an example of forming the material first into one shape, then into a second shape.

EXAMPLE 6

Figure 10:
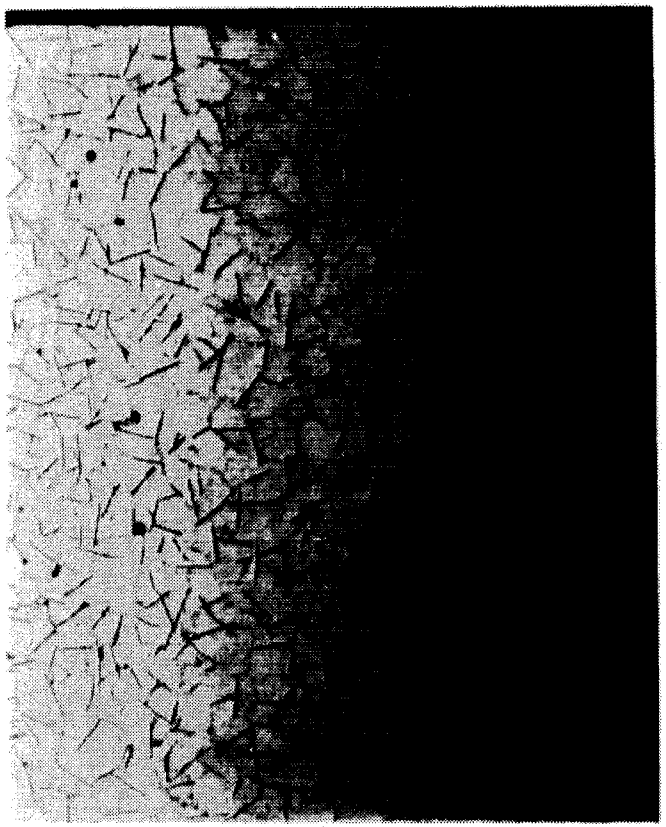
FIG. 10 is an optical photomicrograph of a compact, asHIP'd, after thermal treatment to develop the carbide dispersoid. Magnification is 100×.
Figure 9:
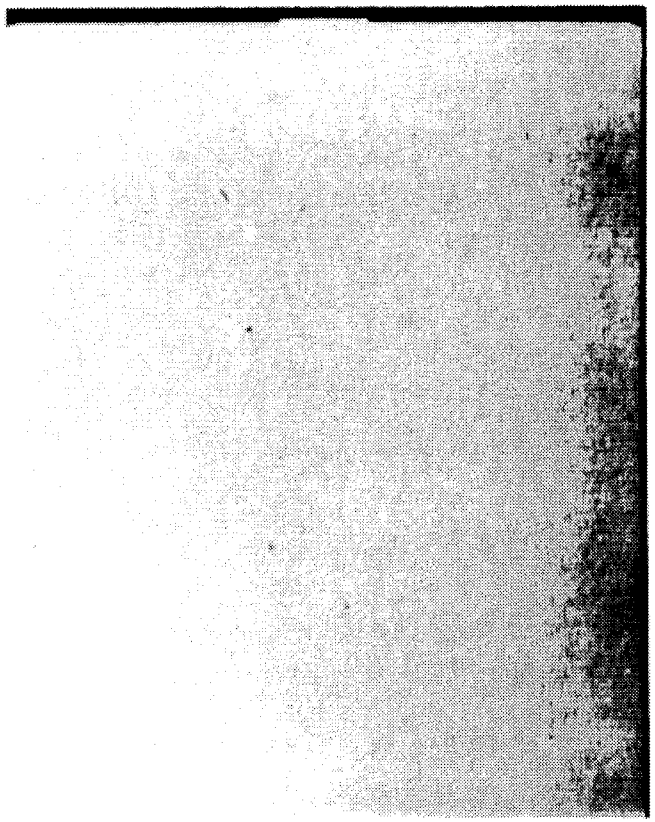
FIG. 9 is an optical photomicrograph of a compact, asHIP'd, without subsequent thermal treatment. Magnification is 100×.

Powder having the composition described in Example 1 was consolidated into compacts by hot isostatic pressing (HIP'ing). HIP'ing temperatures for three different compacts were 1800° F., 2000° F. and 2100° F.; all HIP'ing operations were performed at about 20,000 psi pressure for about four hours. The resulting microstructure, shown in FIG. 9, indicates that formation of the dispersoids was prevented through the powder making and HIP'ing processes. The compacts were then given the same thermal treatment as that used in Example 1. The microstructure after thermal treatment is shown in FIG. 10. Tensile test specimens were cut from the thermally treated compacts HIP'ed at 1800° F. and 2000° F. The results were very similar to those of the RSPD material produced in Example 1.

EXAMPLE 7

The oxidation resistance of the material of Example 1 was determined by placing rods cut from the specimens described in Example 1, each approximately 0.25 inch diameter by 3.5 inches long, in a stream of hot air at 2075° F., moving at a velocity of Mach 1, for about 200 hours. The rods were removed from the stream of hot air for five minutes of each hour of testing. This type of test, widely used in the art, is referred to as the Mach 1 oxidation test. The amount of metal lost through oxidation was about 0.00075 inch on each side of the specimen. In Mach 1 oxidation tests on four commercially available nickel-base superalloys and one advanced single grain nickel-base superalloy especially formulated for good oxidation resistance, the results shown in Table 3 were obtained:

TABLE 3

OXIDATION BEHAVIOR OF NICKEL-BASE ALLOYS

| Alloy | Metal Loss (inch/side) |
|---|---|
| Rene'41 (wrought) | 0.033 |
| Rene'80 (cast) | 0.054 |
| Rene'125 (cast) | 0.023 |
| MA 754 (wrought) | 0.004 |
| Advanced single grain alloy | 0.0005 |
| Alloy of this invention | 0.00075 |

Thus, the oxidation resistance of this material is better than that of the conventional superalloys, approaching that of the advanced single grain alloy.

In light of the foregoing discussion, it will be apparent to those skilled in the art that the present invention is not limited to the embodiments, methods and compositions herein described. Numerous modifications, changes, substitutions and equivalents will become apparent to those skilled in the art, all of which fall within the scope contemplated by the invention.

What is claimed is:

1. A method for producing a nickel-base superalloy article having at least three phases, comprising the steps of:

selecting a near-eutectic nickel-bag superalloy having a composition capable of forming, at equilibrium, at least three phases, a first phase defining a continuous matrix of a nickel-base solid solution, a second phase in the form of a monocarbide dispersion distributed substantially uniformly dispersed throughout the matrix, and a third phase in the form of a gamma-prime precipitate distributed substantially uniformly throughout the matrix;

producing a powder of the superalloy under nonequilibrium conditions so that the matrix is supersaturated with respect to elements of the second phase and elements of the third phase, and substantially free of a dispersion of the second phase and a precipitate of the third phase;

consolidating the powder to form a substantially dense article of a first predetermined shape;

developing in the matrix the dispersion of the second phase by thermally treating the dense article; and developing the precipitate of the third phase by thermally treating the dense article.

2. The method of claim 1, wherein the step of consolidating the powder includes application of heat and pressure.

3. The method of claim 2, wherein the step of consolidating the powder is accomplished by hot isostatic pressing at a temperature from about 1800° F. to about 2100° F., at a pressure up to about 20,000 psi and for a time of up to about 4 hours.

4. The method of claim 1, wherein the step of thermal treating to develop the dispersion is accomplished at a temperature of about 2100° F. for a time of about 6 hours.

5. The method of claim 4, wherein the step of thermally treating the article further includes thermal treating at about 2400° F. for about 4 hours, followed by cooling at about 100° F./minute to a temperature below about 1975° F., followed by thermal treating at about 1975° F. for about 16 hours, followed by thermal treating at about 1650° F. for about 16 hours.

6. A nickel-base superalloy comprising an equilibrium structure having at least three phases, a rust phase defining a continuous matrix of a nickel-base solid solution, a second phase in the form of a monocarbide dispersion distributed throughout the matrix and a third phase selected from the group consisting of gamma-prime precipitates and gamma double-prime precipitates, said third phase distributed substantially uniformly throughout the matrix, wherein manufacture of the superalloy includes the steps of:

incrementally solidifying the superalloy from a melt thereof to form a solid article under nonequilibrium conditions so that the matrix in the article is supersaturated with respect to elements of the second phase and elements of the third phase, and substantially free of a dispersion of the second phase and a precipitate of the third phase;

developing in the matrix by a thermal treatment process the dispersion of the second phase, which is thenceforward substantially insoluble in the matrix; and developing the precipitate of the third phase by a thermal treatment process.

7. The superalloy of claim 6, wherein the superalloy has a near-eutectic composition.

8. A method for producing a nickel-base superalloy article having at least three phases, comprising the steps of:

selecting a near-eutectic nickel-base superalloy composition capable of forming, at equilibrium, at least three phases, a first phase defining a continuous matrix, a second phase dispersed in the matrix, and third phase in the form of a precipitate distributed substantially uniformly in the matrix;

forming liquid droplets of the superalloy composition;

impacting the droplets upon a substrate to form a layer of the superalloy composition on the substrate;

incrementally impacting additional droplets on the superalloy layer and solidifying them thereon at a sufficiently high rate to produce a nonequilibrium structure, wherein the matrix is supersaturated with respect to elements of the second phase and elements of the third phase, and substantially free of a dispersion of the second phase and a precipitate of the third phase, thereby forming a solid article having a first predetermined shape;

developing in the matrix the dispersion of the second phase by thermally treating the solid article; and developing the precipitate particles of the third phase by thermally treating the solid article.

9. The method of claim 8, wherein the first phase is a nickel-base solid solution, the second phase is a monocarbide and the third phase is gamma-prime.

10. The method of claim 8, wherein the solid article is an ingot.

11. The method of claim 8, wherein the liquid droplets are formed by injecting powder particles of the superalloy composition into a plume generated by a plasma torch.

12. The method of claim 8, wherein the step of developing the dispersion is accomplished at a temperature of about 2100° F. for a time of about 6 hours.

13. The method of claim 12, wherein the additional step of thermal treatment comprises thermal treatment at about 2400° F. for about 4 hours, followed by cooling at about 100° F./minute to a temperature below about 1975° F., followed by thermal treatment at about 1975° F. for about 16 hours, followed by thermal treatment at about 1650° F. for about 16 hours.

14. A metal matrix composite material comprising a plurality of reinforcing fibers disposed in a predetermined arrangement within a matrix material comprised of a nickel-base superalloy comprising an equilibrium structure having at least three phases, a first phase defining a continuous matrix, a second phase in the form of a dispersion distributed throughout the matrix and a third phase in the form of a precipitate distributed substantially uniformly throughout the matrix, wherein manufacture of the superalloy includes the steps of:

producing a powder of the superalloy under nonequilibrium conditions so that the matrix is supersaturated with respect to elements of the second phase and elements of the third phase, and substantially free of a dispersion of the second phase and a precipitate of the third phase;

developing in the matrix by a thermal treatment process the dispersion of the second phase, which is thenceforward substantially insoluble in the matrix; and developing the precipitate of the third phase by a thermal treatment process.

15. The metal matrix composite material of claim 14, wherein the reinforcing fibers are comprised of a material selected from the group consisting of carbides, oxides, nitrides, oxynitrides and carbonitrides.

16. The metal matrix composite material of claim 14, wherein the first phase is a nickel-base solid solution, the second phase is a monocarbide and the third phase is gamma-prime.

17. The metal matrix composite material of claim 16, wherein the superalloy has a near-eutectic composition.

18. A method for producing a metal matrix composite article comprising the steps of:

selecting a reinforcing fiber material from the group consisting of carbides, oxides, nitrides, oxynitrides and carbonitrides;

selecting a near-eutectic nickel-base superalloy composition capable of forming, at equilibrium, at least three phases, a first phase defining a continuous matrix, a second phase dispersed in the matrix, and a third phase in the form of a precipitate distributed in the matrix;

producing a powder of the superalloy under nonequilibrium conditions so that the matrix is supersaturated with respect to elements of the second phase and elements of the third phase, and substantially free of a dispersion of the second phase and a precipitate of the third phase;

disposing fibers of the reinforcing fiber material and the powder in predetermined positions appropriate to the design of the metal matrix composite article;

consolidating the fibers and the powder to form the metal matrix composite article;

developing in the matrix by a thermal treatment process the dispersion of the second phase, which is thenceforward substantially insoluble in the matrix; and developing the precipitate of the third phase by a thermal treatment process.

19. The method of claim 18, wherein the first phase is a nickel-base solid solution, the second phase is a monocarbide and the third phase is gamma-prime.

20. The method of claim 18, wherein the step of consolidating the fibers and the powder includes application of heat and pressure.

21. The method of claim 20, wherein the step of consolidating the fibers and the powder is accomplished by hot isostatic pressing at a temperature from about 1800° F. to about 2100° F., at a pressure up to about 20,000 psi and for a time of up to about 4 hours.

22. The method of claim 18, wherein the step of developing the dispersion is accomplished at a temperature of about 2100° F. for a time of about 6 hours.

23. The method of claim 22, wherein the additional step of thermal treatment comprises thermal treatment at about 2400° F. for about 4 hours, followed by cooling at about 100° F./minute to a temperature below about 1975° F., followed by thermal treatment at about 1975° F. for about 16 hours, followed by thermal treatment at 1650° F. for about 16 hours.

24. A method for producing a metal matrix composite article comprising the steps of:

selecting a reinforcing fiber material from the group consisting of carbides, oxides, nitrides, oxynitrides and carbonitrides;

selecting a near-eutectic nickel-base superalloy composition capable of forming, at equilibrium, at least three phases, a first phase defining a continuous matrix, a second phase dispersed in the matrix, and a third phase in the form of a precipitate distributed in the matrix;

forming liquid droplets of the superalloy composition;

impacting the droplets upon a substrate to form a layer of the superalloy composition on the substrate;

alternately disposing fibers of the reinforcing fiber material over the layer of superalloy composition, incrementally impacting additional droplets on and around the fibers and over the superalloy layer, and solidifying them thereon at a sufficiently high rate to produce a nonequilibrium structure, wherein the matrix is supersaturated with respect to elements of the second phase and elements of the third phase, and substantially free of a dispersion of the second phase and a precipitate of the third phase, thereby forming a solid article having a first predetermined shape and having reinforcing fibers embedded therein;

developing in the matrix by a thermal treatment process the dispersion of the second phase, which is thenceforward substantially insoluble in the matrix; and developing the precipitate of the third phase by a thermal treatment process.

25. A method for producing a nickel-base superalloy article having at least three phases, comprising the steps of:

selecting a near-eutectic nickel-base superalloy having a composition consisting essentially of, in weight percent: from about 5.0 to about 6.5 percent Al, from about 4.0 to about 7.5 percent Cr, from about 3.0 to about 6.0 W, from about 3.0 to about 7.5 percent Re, from about 5.0 to about 12.0 percent Ta, from about 3.0 to about 14.0 percent Co, from 0 to about 2.0 percent Nb, from 0 to about 4.0 percent Mo, from about 0.15 to about 0.35 percent C, from 0 to about 0.04 percent B, from 0 to about 0.2 percent Zr, from 0 to about 0.5 percent Hf, from 0 to abut 2.0 percent Ti, from about 0.02 to about 0.1 percent Y, and from 0 to about 3.0 percent V, the balance essentially nickel and capable of forming, at equilibrium, at least three phases, a first phase defining a continuous matrix of a nickel-base solid solution, a second phase in the form of a monocarbide dispersion distributed substantially uniformly dispersed throughout the matrix, and a third phase in the form of a gamma-prime precipitate distributed substantially uniformly throughout the matrix;

producing a powder of the superalloy under nonequilibrium conditions so that the matrix is supersaturated with respect to elements of the second phase and elements of the third phase, and substantially free of a dispersion of the second phase and a precipitate of the third phase;

consolidating the powder to form a substantially dense article of a fast predetermined shape;

developing in the matrix the dispersion of the second phase by thermally treating the dense article; and developing the precipitate of the third phase by thermally treating the dense article.

26. The method of claim 25, wherein the step of selecting a near-eutectic nickel base superalloy includes selecting an alloy consists essentially of, in weight percent: from about 5.3 to about 5.7 percent Al, from about 4.0 to about 4.4 percent Cr, from about 4.3 to about 4.7 W, from about 6.6 to about 7.1 percent Re, from about 8.2 to about 8.6 percent Ta, from about 3.8 to about 4.2 percent Co, from 0 to about 0.2 percent Nb, from about 3.0 to abut 3.4 percent Mo, from about 0.21 to about 0.25 percent C, from about 0.025 to about 0.035 percent B, from 0 to about 0.1 percent Zr, from about 0.08 to about 0.12 percent Hf, from 0 to about 2.0 percent Ti, from about 0.045 to about 0.055 percent Y, and from 0 to about 0.2 percent V, the balance essentially nickel.

* * * * *